US012259198B2

(12) United States Patent
Ajima et al.

(10) Patent No.: US 12,259,198 B2
(45) Date of Patent: Mar. 25, 2025

(54) FINNED TUBE HEAT EXCHANGER

(71) Applicant: FUJI ELECTRIC CO., LTD., Kawasaki (JP)

(72) Inventors: Masaaki Ajima, Kawasaki (JP); Masamichi Iwasaki, Kawasaki (JP); Jun Nakamura, Kawasaki (JP); Yasuhiro Yokoyama, Kawasaki (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 236 days.

(21) Appl. No.: 17/876,075

(22) Filed: Jul. 28, 2022

(65) Prior Publication Data

US 2022/0364799 A1 Nov. 17, 2022

Related U.S. Application Data

(63) Continuation of application No. PCT/JP2021/024091, filed on Jun. 25, 2021.

(30) Foreign Application Priority Data

Aug. 24, 2020 (JP) ..... 2020-140874

(51) Int. Cl.
*F28F 1/32* (2006.01)
*F28D 1/053* (2006.01)

(52) U.S. Cl.
CPC ..... *F28F 1/32* (2013.01); *F28D 1/053* (2013.01)

(58) Field of Classification Search
CPC ..... F28F 1/32; F28D 1/053
(Continued)

(56) References Cited

U.S. PATENT DOCUMENTS 2,813,698 A * 11/1957 Lincoln ..... F28D 15/0275 165/181
3,116,134 A * 12/1963 May ..... F01D 25/20 165/145

(Continued)

FOREIGN PATENT DOCUMENTS

EP 2037186 A1 3/2009
JP S59103071 U 7/1984

(Continued)

OTHER PUBLICATIONS

International Search Report for PCT/JP2021/024091, mailed on Sep. 7, 2021.

*Primary Examiner* — Raheena R Malik
(74) *Attorney, Agent, or Firm* — Rabin & Berdo, P.C.

(57) ABSTRACT

A finned tube heat exchanger includes a plurality of tube arrays, each of which includes a plurality of heat transfer tubes that each extend parallel to one another and are disposed at a predetermined pitch in a first direction that intersects a flow direction of heat exchanging air, in a second direction that intersects the first direction, any closest two of the plurality of tube arrays having a predetermined distance therebetween. One closest two tube arrays includes first and second tube arrays that respectively include a plurality of first heat transfer tubes and a plurality of second heat transfer tubes. When seen from the flow direction, each first heat transfer tube is disposed closer to one of an adjacent two second heat transfer tubes that is closest to said each first heat transfer tube, than to the other one of the adjacent two second heat transfer tubes.

5 Claims, 7 Drawing Sheets

(58) Field of Classification Search
USPC ..... 165/151
See application file for complete search history.

(56) References Cited

U.S. PATENT DOCUMENTS 3,163,208 A * 12/1964 Cuzzone ..... F28F 9/0132 165/172
3,267,914 A * 8/1966 Connell ..... F22D 1/10 122/510
3,366,172 A * 1/1968 Doroszlai ..... F28D 7/1653 165/172
3,391,732 A * 7/1968 Murray ..... F28D 1/0535 165/76
3,627,034 A * 12/1971 Howe ..... F28D 7/163 165/47
4,552,292 A * 11/1985 Cuscino ..... F22B 21/28 228/183
4,660,627 A * 4/1987 Deck ..... F28G 3/166 165/95
4,854,381 A * 8/1989 Mikula ..... F28F 1/24 126/307 R
5,632,149 A * 5/1997 Tanigawa ..... F02G 1/055 60/520
5,975,198 A * 11/1999 Kim ..... F28F 1/32 165/910
6,964,297 B1 * 11/2005 Janezich ..... F28F 9/14 285/19
7,255,157 B2 * 8/2007 Richardson ..... F28D 7/1638 165/158
7,650,933 B2 * 1/2010 Gilbert ..... F24H 9/0026 165/134.1
8,251,134 B2 * 8/2012 Janezich ..... F28F 9/06 165/173
2010/0326643 A1 12/2010 Hancock
2021/0285727 A1 * 9/2021 Aute ..... B23P 15/26
2022/0364799 A1 * 11/2022 Ajima ..... F28D 1/053

FOREIGN PATENT DOCUMENTS

JP S61285395 A 12/1986
JP S64006699 A 1/1989
JP H09026283 A 1/1997
JP H10332290 A 12/1998
JP 2000274982 A 10/2000
JP 2001317890 A 11/2001
JP 2007170733 A 7/2007
JP 2007322061 A 12/2007
JP 2008057944 A 3/2008
JP 2011237047 A 11/2011
JP 2012225545 A 11/2012
JP 2012531574 A 12/2012
JP 2013092306 A 5/2013

* cited by examiner

FINNED TUBE HEAT EXCHANGER

CROSS REFERENCE TO RELATED APPLICATIONS

This is a continuation application of International Application PCT/JP2021/024091 filed on Jun. 25, 2022 which claims priority from a Japanese Patent Application No. 2020-140874 filed on Aug. 24, 2020, the contents of which are incorporated herein by reference.

BACKGROUND OF THE INVENTION

Technical Field

The present invention relates to a finned tube heat exchanger.

Background Art

As heat exchangers for industrial use, finned tube heat exchangers are typically used. Such a finned tube heat exchanger, which includes a plurality of heat transfer tubes arranged in a direction that intersects a flow direction of heat exchanging air and a plurality of fins (heat transfer plate) disposed in a tube axis direction of these heat transfer tubes, allows a liquid medium to flow in the heat transfer tubes and brings gaseous body (heat exchanging air) into contact with outer circumferential surfaces of the heat transfer tubes and the fins to achieve heat exchange therebetween. The plurality of fins increase a heat transfer area and contribute to an increase in amount of heat transport.

In the related art, various proposals have been made for improving heat exchanging efficiency while suppressing an increase in airflow resistance in such a finned tube heat exchanger (see Patent Literatures 1 to 4, for example). In this type of finned tube heat exchanger, the plurality of heat transfer tubes are arranged at a predetermined pitch and form one tube array, and further, a plurality of tube arrays are arranged in a predetermined direction.

CITATION LIST

Patent Literature

[Patent Literature 1] Japanese Patent Laid-Open No. 2013-92306

[Patent Literature 2] Japanese Patent Laid-Open No. 2011-237047

[Patent Literature 3] Japanese Patent Laid-Open No. 2008-57944

[Patent Literature 4] Japanese Patent Laid-Open No. 61-285395

SUMMARY OF THE INVENTION

Incidentally, in the finned tube heat exchanger as described above, the plurality of heat transfer tubes are disposed in a regularly arranged manner at a predetermined pitch. Therefore, there is a problem that a flow resistance of the heat exchanging air flowing outside the heat transfer tube may increase and a pressure loss may increase depending on the outer diameter and the pitch of the heat transfer tubes.

An object of the present invention, which has been made in view of such a point, is to provide a finned tube heat exchanger capable of reducing a pressure loss of heat exchanging air while maintaining heat exchanging performance.

A finned tube heat exchanger according to an aspect of the present invention includes: tube arrays in which a plurality of heat transfer tubes are disposed side by side at a predetermined pitch in a first direction that intersects a flow direction of heat exchanging air, the plurality of tube arrays being disposed at a predetermined interval in a second direction that intersects the first direction, in which a predetermined tube array is disposed in an offset manner in the first direction relative to different tube arrays that are adjacent in the second direction, and when seen from the flow direction of the heat exchanging air, the heat transfer tubes in the predetermined tube array are disposed nearer to a side of the heat transfer tubes in the different tube arrays that are adjacent.

According to the present invention, it is possible to reduce a pressure loss of heat exchanging air while maintaining heat exchanging performance.

DESCRIPTION OF THE INVENTION

Figure 1:
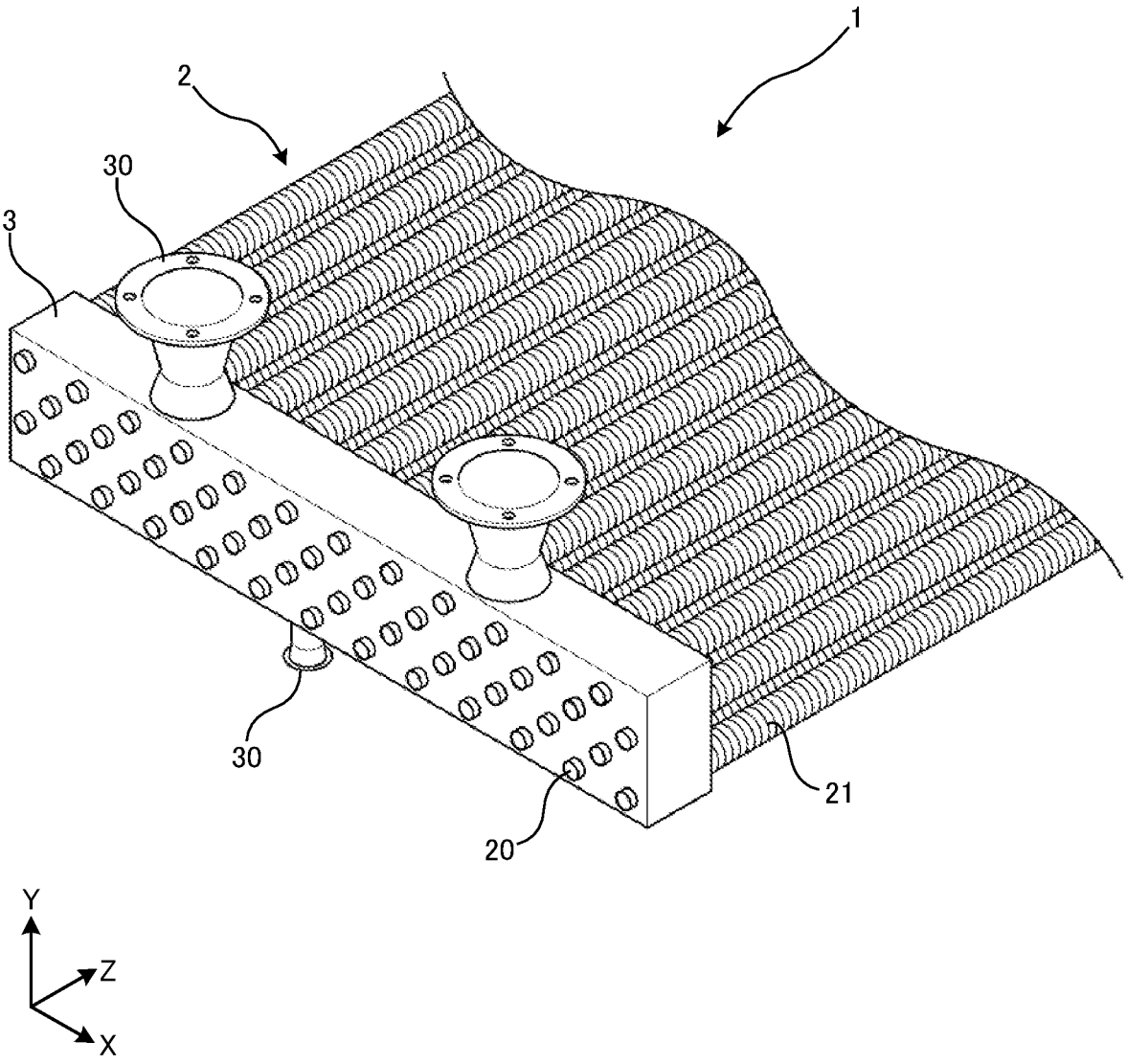
FIG. 1 is an outline perspective view of a finned tube heat exchanger according to the present embodiment.

Hereinafter, a plurality of embodiments of the present invention will be described with reference to the accompanying drawings. A finned tube heat exchanger (tube fin heat exchanger) according to the present invention is suitably used for a radiator of a condenser placed in a geothermal power generation facility, for example. However, the finned tube heat exchanger according to the present invention is not limited thereto and can be applied to an arbitrary heat exchanger such as an air cooled heat exchanger in a petrochemical plant or an oil refinery or an air cooled condenser for an incinerator.

In the following drawings, a first direction in which a plurality of heat transfer tubes are arranged will be defined to as an X direction, a second direction in which a plurality of tube arrays are arranged will be defined to as a Y direction, and an axial direction (extending direction) of the heat transfer tubes will be defined as a Z direction. Each of the X, Y, and Z axes illustrated in the drawing perpendicularly intersect each other. Alternatively, the X direction may be referred to as a left-right direction, the Y direction may be referred to as an up-down direction, and the Z direction may be referred to as a front-back direction in some cases. These directions (front-back, left-right, and up-down direction) are terms used for convenience of explanation, and a correspondence with each of the X, Y, and Z directions may change depending on a posture in which the finned tube heat exchanger is attached. For example, a side on which intake air (heat exchanging air) is suctioned to the finned tube heat exchanger will be referred to as a lower surface side, and an air blow-out side that is the opposite side will be referred to as an upper surface side. In the present specification, a plan view means a case in which the upper surface of the finned tube heat exchanger is seen from the positive side in the Y direction, and a sectional view means a case when seen from the axial direction (Z direction) of the heat transfer tubes unless particularly indicated otherwise.

Figure 2:
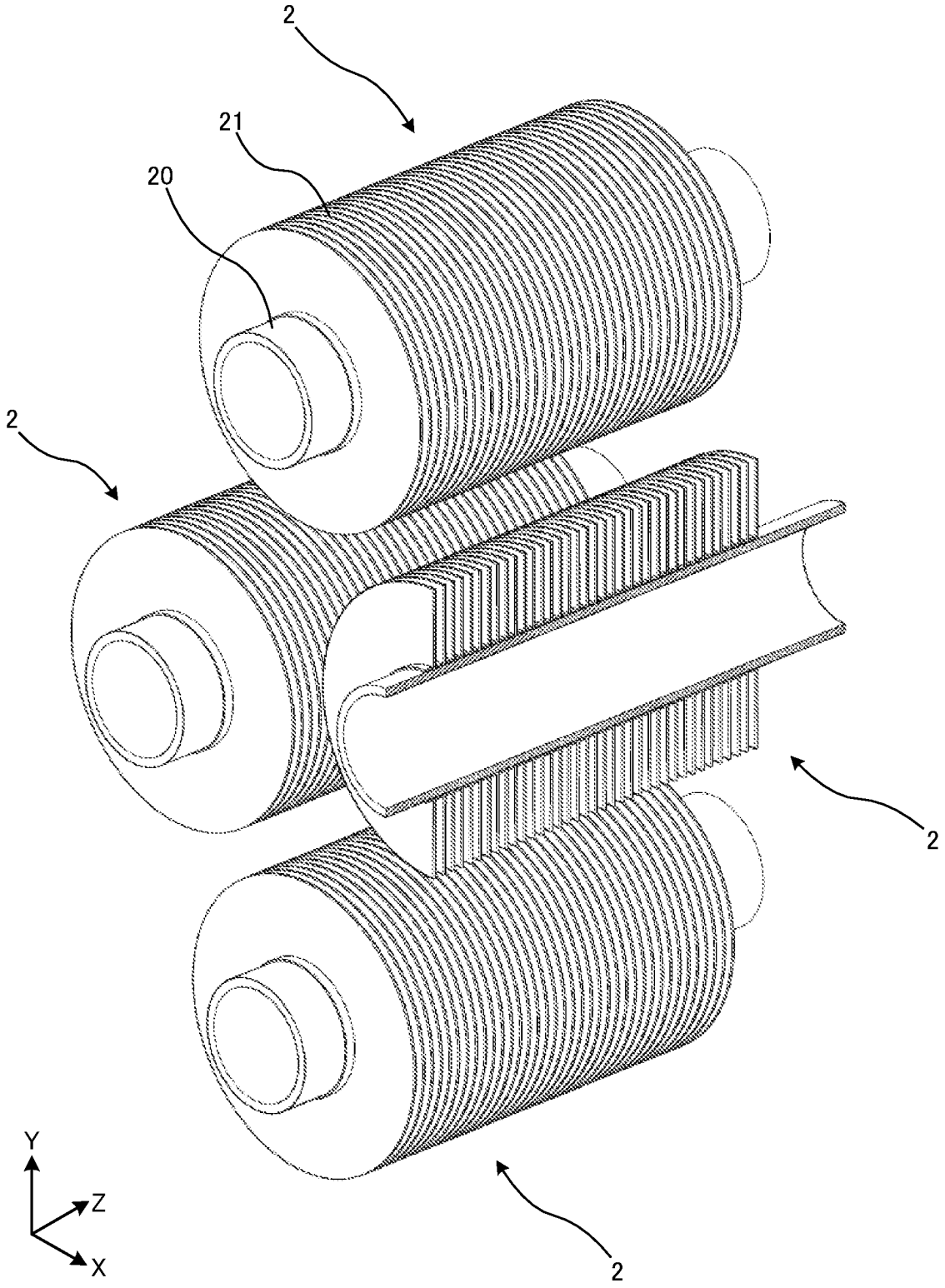
FIG. 2 is a partially enlarged view of the finned tube heat exchanger according to the present embodiment.

FIG. 1 is an outline perspective view of the finned tube heat exchanger according to the present embodiment. FIG. 2 is a partially enlarged view of the finned tube heat exchanger according to the present embodiment. FIG. 2 illustrates a part of finned tubes in an excerpted manner and illustrates a section of a part of the finned tubes, for convenience of explanation.

A finned tube heat exchanger 1 according to the present embodiment (hereinafter, simply referred to as a heat exchanger) is made up of a radiator for air cooled geothermal binary power generation, for example. As will be described later in detail, the heat exchanger 1 realizes heat exchange between a refrigerant flowing inside the transfer tubes 20 and air flowing outside the heat transfer tubes 20.

As illustrated in FIGS. 1 and 2, the heat exchanger 1 is formed into a flat shape with a predetermined thickness in the up-down direction (Y direction) in a plan view rectangle. Specifically, the heat exchanger 1 is made up of the plurality of heat transfer tubes 20 extending in the Z direction being disposed side by side in the X direction and the Y direction and by both ends of the heat transfer tubes 20 in the Z direction being coupled to a pair of header portions 3. Note that FIG. 1 illustrates only the header portion 3 on one end side (the negative side in the Z direction) out of the pair of header portions 3 for convenience of explanation.

The heat transfer tubes 20 have hollow cylindrical shapes (circular tube shapes) with a predetermined outer diameter D (see FIG. 4) and extend in the Z direction that is the front-back direction. A fluid that acts as a refrigerant can flow through the inside of the heat transfer tube 20. As the refrigerant introduced into the heat transfer tubes 20, warm water can be used, for example. Note that the refrigerant is not limited to the warm water and another fluid (pentane, alternative freon, or the like) may be used. Although details will be described later, the surface temperature of the heat transfer tube 20 changes in accordance with the temperature of the refrigerant flowing therein.

A plurality of fins 21 (heat transfer plates) are provided on outer circumferential surfaces of the heat transfer tubes 20. The fins 21 have substantially annular shapes when seen from the axial direction (Z direction) of the heat transfer tube 20 and are formed of plate-shaped elements with thicknesses in the Z direction. The fins 21 may be joined to the outer circumferential surfaces of the heat transfer tubes 20 through tube expansion of expanding a part or an entirety of the outer diameters of the heat transfer tubes 20, for example. Also, the plurality of fins 21 are disposed at a predetermined interval in the Z direction on the outer circumferential surfaces of the heat transfer tubes 20. The plurality of fins 21 have the same shapes. Note that the heat transfer tubes 20 and the plurality of fins 21 may be collectively referred to as finned tubes 2.

The plurality of heat transfer tubes 20 (finned tubes 2) thus configured are arranged at a predetermined pitch P1 in the X direction (first direction), and one tube array 22 (see FIG. 4) is thereby formed. More specifically, the plurality of heat transfer tubes 20 configuring the one tube array 22 are disposed side by side in a direction (X direction) that intersects a flow direction (up-down direction) of heat exchanging air. Also, a plurality of tube arrays 22 are disposed side by side at a predetermined interval P2 in the Y direction (second direction) in the heat exchanger 1. Note that the layout of the plurality of tube arrays 22 and the plurality of heat transfer tubes 20 will be described later. The plurality of tube arrays 22 may be collectively referred to as a tube bundle. Note that the predetermined outer diameter D of all the plurality of heat transfer tubes 20 is preferably the same.

As described above, the pair of header portions 3 are coupled to axial ends of the heat transfer tubes 20. The header portions 3 have rectangular parallelepiped shapes corresponding to the widths of the tube bundle in the X direction and the Y direction and are made up of tanks that are hollow inside. Axial end portions of the plurality of heat transfer tubes 20 penetrate through side surfaces of the header portions 3. Inner spaces of the heat transfer tubes 20 communicate with inner spaces of the header portions 3. Also, upper surfaces and lower surfaces of the header portions 3 are provided with inlets/outlets 30 for the refrigerant. In other words, the inner spaces of the header portions 3 and the inner spaces of the heat transfer tubes 20 configure flow paths for the refrigerant.

A blower (not illustrated), for example, is disposed to face the upper surface side of the heat exchanger 1 thus configured. The blower suctions air (heat exchanging air) from the lower side of the heat exchanger 1 and feeds the air to the outer space located on the upper side. In other words, the heat exchanging air flows in the up-down direction of the heat exchanger 1. The suctioned heat exchanging air is warmed through heat exchange in the heat exchanger 1 and is then discharged to the outside. In other words, the lower surface side of the heat exchanger 1 is an upstream side, and the upper surface side of the heat exchanger 1 is a downstream side, relative to the flow direction of the heat exchanging air.

In other words, the flow direction of the heat exchanging air is directed from the negative side in the Y direction to the positive side in the Y direction. The X direction that is the first direction intersects the flow direction of the heat exchanging air. Also, the Y direction that is the second direction perpendicularly intersects the first direction and conforms to the flow direction of the heat exchanging air.

Figure 3:
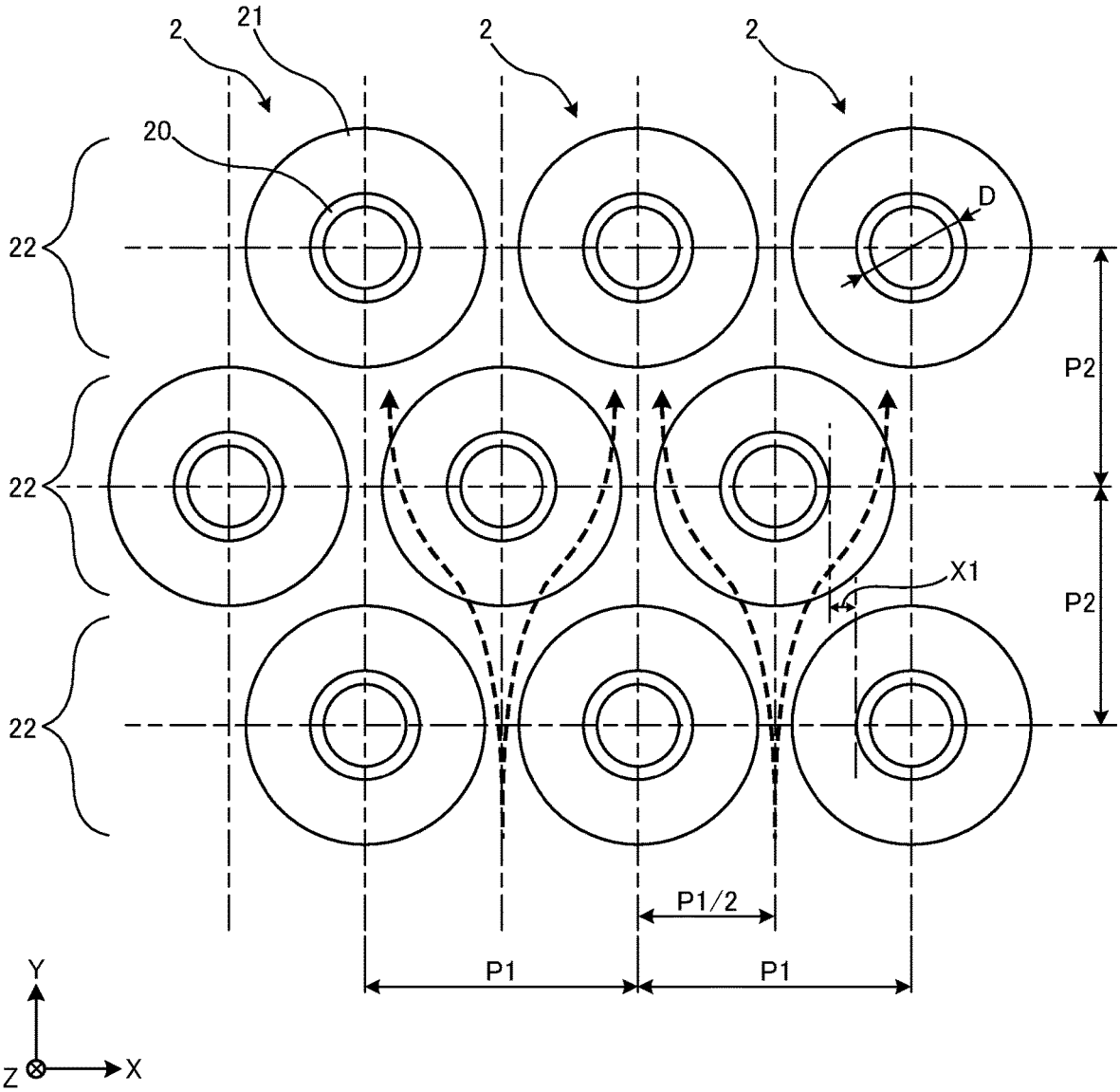
FIG. 3 is a sectional schematic view of a finned tube heat exchanger according to a comparative example.
Figure 4:
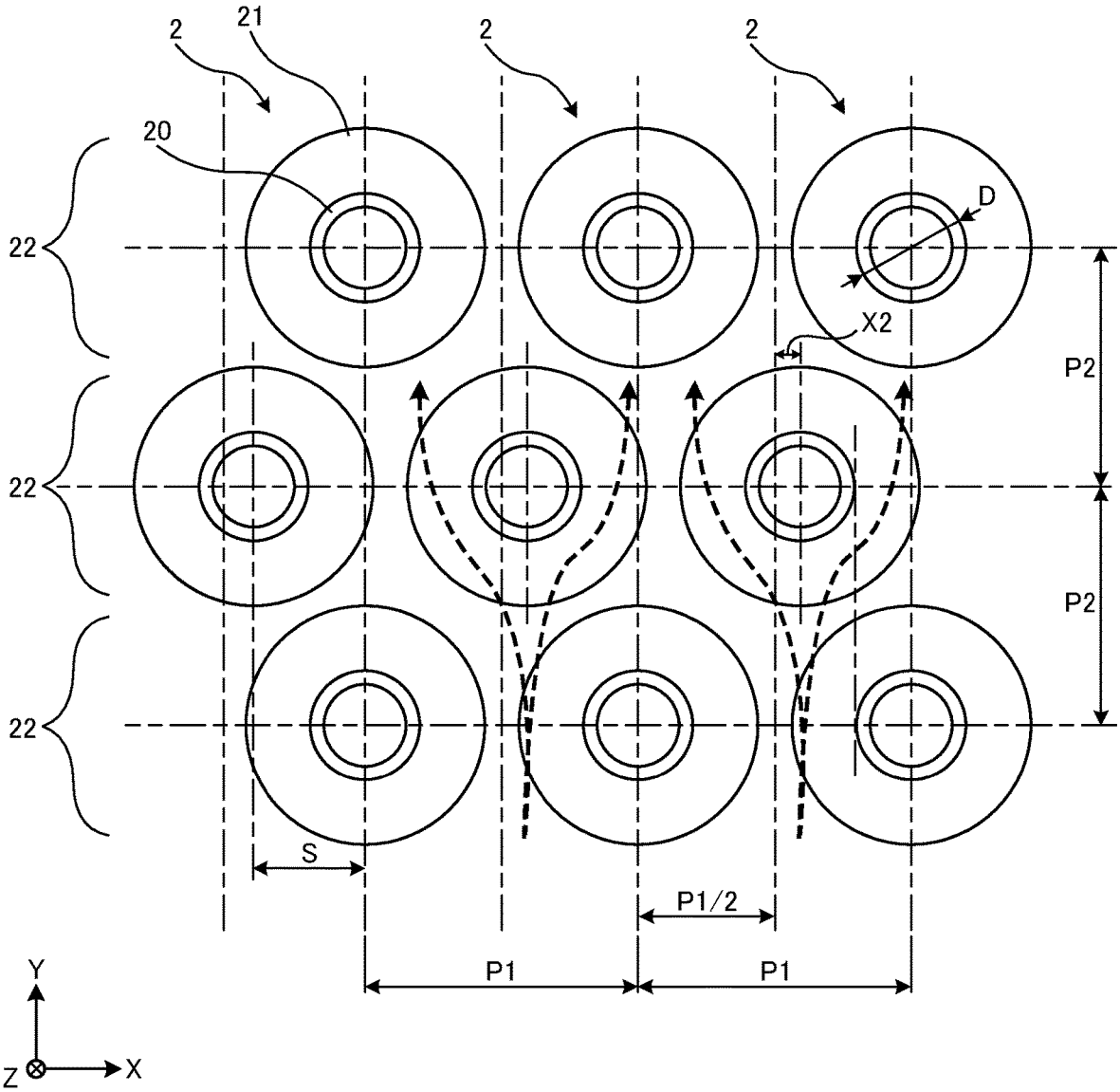
FIG. 4 is a sectional schematic view of a finned tube heat exchanger according to a first embodiment.

Here, a finned tube heat exchanger according to a first embodiment will be described with reference to a comparative example. FIG. 3 is a sectional schematic view of a finned tube heat exchanger according to the comparative example. FIG. 4 is a sectional schematic view of the finned tube heat exchanger according to the first embodiment. Note that the configuration of the heat exchanger according to the comparative example in FIG. 3 is different only in the layout of the finned tubes and is thus illustrated using the same reference signs as those in the configuration that has already been described above.

In the heat exchanger 1 in the related art, a predetermined tube array 22 is disposed in an offset manner in the X direction relative to different tube arrays 22 that are adjacent in the Y direction as illustrated in the comparative example in FIG. 3. More specifically, the predetermined tube array 22 is disposed at a position (hereinafter, referred to as a reference position) that offsets in the X direction by a half pitch P½ of the predetermined pitch P1 relative to the different tube arrays 22. Such arrangement of the tube arrays 22 may be referred to as staggered arrangement. In the staggered arrangement, the plurality of tube arrays 22 are disposed in an alternate manner with an offset of a half pitch P½. In FIG. 3, the outer surfaces of the heat transfer tubes 20 in the predetermined tube array 22 and the outer surfaces of the heat transfer tubes 20 in the different tube arrays 22 that are adjacent are separated from each other by a distance X1 when seen from the flow direction of the heat exchanging air, for example.

In the case of the staggered arrangement as illustrated in FIG. 3, the heat exchanging air flowing in from the lower surface side of the heat exchanger 1 collides directly against the centers of the heat transfer tubes 20. Therefore, there is a problem that a pressure loss increases. Additionally, there is also a concern that heat exchange may not be sufficiently performed in the heat transfer tubes 20 on the further downstream side than the upstream side and heat exchanging performance may be degraded.

The blower used for radiator of air cooled geothermal binary power generation as described above, in particular, is driven using power generated by a system. Therefore, a pressure loss is high, and power consumption of the blower increases, and as a result, transmission power is reduced. Thus, reduction of the pressure loss and thus an increase in transmission power have been required.

Thus, the present inventors have focused on arrangement of the heat transfer tubes 20 that are components of the heat exchanger 1 and have achieved the present invention. Specifically, in the present embodiment, the plurality of heat transfer tubes 20 are disposed side by side at the predetermined pitch P1 in the X direction, and the tube arrays 22 are thus formed, as illustrated in FIG. 4. Also, the plurality of tube arrays 22 are disposed side by side at the predetermined interval P2 in the Y direction.

The predetermined tube array 22 from among the plurality of tube arrays 22 is disposed in an offset manner in the X direction relative to the different tube arrays 22 that are adjacent in the Y direction. In particular, the heat transfer tubes 20 in the predetermined tube array 22 are disposed nearer to the side of the heat transfer tubes 20 in the different tube arrays 22 that are adjacent when seen from the flow direction of the heat exchanging air.

More specifically, the predetermined tube arrays 22 are disposed nearer to one side (the positive side, for example) by a distance X2 in the X direction beyond the reference position that offsets in the X direction by the half pitch P½ of the predetermined pitch P1 relative to the different tube arrays 22. In other words, the predetermined tube array 22 is disposed at a location that offsets by the distance (P½±X2) relative to the different tube arrays 22.

According to this configuration, the predetermined tube array 22 is disposed with a slight offset from the staggered arrangement, the heat exchanging air flowing in from the lower surface side of the heat exchanger 1 thus does not collide directly against the centers of the heat transfer tubes 20, and it is possible to reduce a pressure loss. Also, even when the predetermined array 22 slightly offsets from the staggered arrangement, the heat exchanging air that has flowed through the tube arrays 22 on the upstream side (the negative side in the Y direction) flows to be attracted to the outer circumferential surfaces of predetermined heat transfer tubes 20 in the tube arrays 22 on the downstream side due to a Coanda effect. Therefore, the heat exchanging air can branch into two left and right parts in the X direction and flow without being biased in the tube arrays 22 on the downstream side. It is thus possible to reduce a pressure loss of the heat exchanging air while maintaining heat exchanging performance.

In the present embodiment, the heat transfer tubes 20 in the predetermined tube array 22 are preferably disposed adjacent to the outer surfaces of the heat transfer tubes 20 in the different tube arrays 22 that are adjacent, when seen from the flow direction of the heat exchanging air as illustrated in FIG. 4. In other words, the distance X1 between the outer surfaces of the heat transfer tubes 20 in the predetermined tube array 22 illustrated in FIG. 3 and the outer surfaces of the heat transfer tubes 20 in the different tube arrays 22 that are adjacent is preferably zero.

According to this configuration, the heat exchanging air that has flowed through the tube arrays 22 on the upstream side flows both left and right sides without being biased on one side in the tube arrays 22 on the downstream side due to a Coanda effect as described above. As a result, it is possible to maintain heat exchanging performance that is equivalent to performance of the staggered arrangement in the related art. Since the flow path area of the heat exchanging air flowing through the tube arrays 22 on the downstream side increases, it is possible to realize reduction of a pressure loss.

Note that in the present embodiment, the amount of offset of the predetermined tube array 22 relative to the staggered arrangement preferably falls within a predetermined range. Specifically, when the distance between the centers of the heat transfer tubes 20 in the predetermined tube array 22 and the centers of the heat transfer tubes 20 in the different tube arrays 22 that are adjacent when seen from the flow direction of the heat exchanging air is assumed to be S, and the outer diameter of the heat transfer tubes 20 is assumed to be D, a relationship of $0.95 \leq S/D \leq 1.38$ is preferably satisfied.

Figure 5:
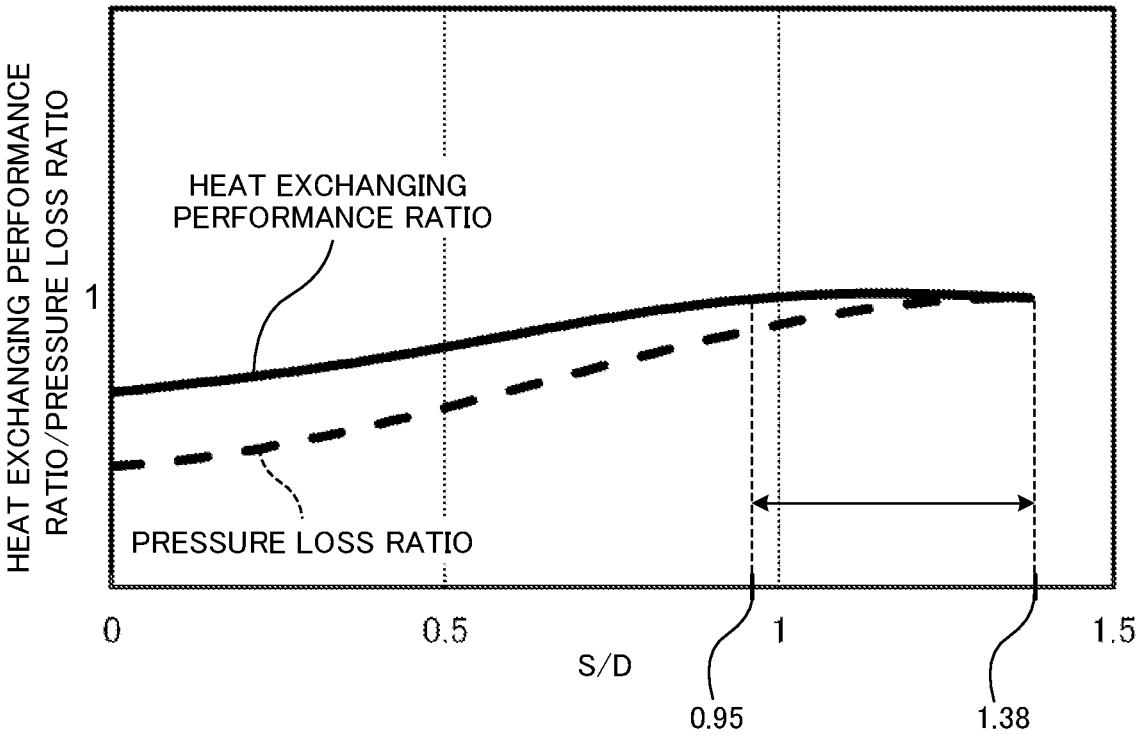
FIG. 5 is a graph illustrating a heat exchanging performance ratio and a pressure loss ratio in accordance with positions of the heat transfer tubes.

Here, a relationship of the positions of the heat transfer tubes 20, heat exchanging performance, and the like will be described. FIG. 5 is a graph illustrating a heat exchanging performance ratio and a pressure loss ratio in accordance with the positions of the heat transfer tubes 20. In FIG. 5, the horizontal axis represents a ratio S/D between the distance S between the centers described above and the outer diameter D of the heat transfer tube, and the vertical axis represents a heat exchanging performance ratio or a pressure loss ratio. Also, in the graph in FIG. 5, the solid line represents the heat exchanging performance ratio, and the dashed line represents the pressure loss ratio.

As illustrated in FIG. 5, staggered arrangement illustrated in FIG. 3 is exemplified as the region where S/D is greater than 1.38. Description will be given on the assumption that the heat exchanging performance ratio and the pressure loss ratio in the staggered arrangement are "1" as references. As the amount of offset of the predetermined tube array 22 increases from the staggered arrangement, that is, as the heat transfer tubes 20 in the predetermined tube array 22 are made closer to the heat transfer tubes 20 in the different tube arrays 22 that are adjacent (the distance S between the centers is reduced), S/D gradually decreases.

As S/D is equal to or less than 1.38, the pressure loss ratio gradually decreases as S/D decreases. Also, within the range of $0.95 \leq S/D \leq 1.38$, the heat exchanging performance ratio is constant at about "1". As S/D falls below 0.95, the heat exchanging performance ratio gradually decreases. In other words, within the range of $0.95 \leq S/D \leq 1.38$, it is possible to reduce a pressure loss ratio while maintaining the heat exchanging performance ratio to be equivalent to that in the staggered arrangement in the related art.

Note that in a case in which the heat transfer tubes 20 in the predetermined tube array 22 are disposed in contact with the outer surfaces of the heat transfer tubes 20 in the different tube arrays 22 that are adjacent (in a case in which X1=0) when seen from the flow direction of the heat exchanging air as illustrated in FIG. 4, S/D=1 is achieved, and an aspect in which the effect of the present invention can be obtained to the maximum extent is achieved.

Figure 6:
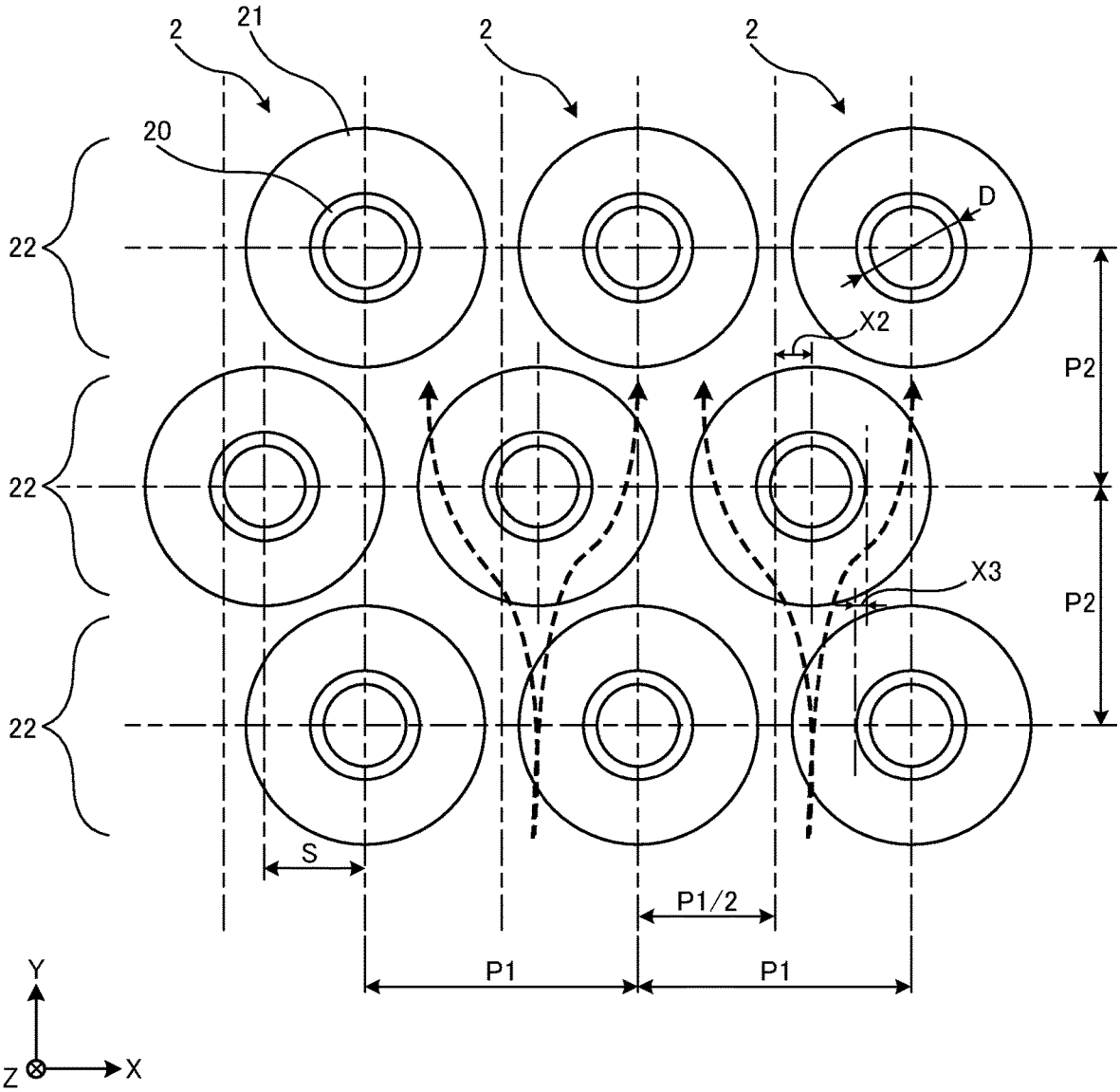
FIG. 6 is a sectional schematic view of a finned tube heat exchanger according to a first modification example.

The positional relationship of the tube arrays 22 is not limited to the aspect illustrated in FIG. 4 and can be appropriately changed within the aforementioned range of S/D. For example, the layout illustrated in FIG. 6 can also be employed. FIG. 6 is a sectional schematic view of a finned tube heat exchanger according to a first modification example.

As illustrated in FIG. 6, the heat transfer tubes 20 in the predetermined tube array 22 are disposed such that at least a part thereof overlaps the heat transfer tubes 20 in the different tube arrays 22 that are adjacent by a distance X3 when seen from the flow direction of the heat exchanging air in the first modification example. In this case, the distance X3 is preferably set to fall within the aforementioned range of S/D (more specifically, $0.95 \leq S/D < 1$). It is possible to reduce a pressure loss ratio while maintaining the heat exchanging performance ratio to be equivalent to that of the staggered arrangement in the related art even with such a configuration.

As described above, according to the first embodiment, it is possible to reduce a pressure loss of the heat exchanging air while maintaining heat exchanging performance by disposing the predetermined tube array 22 nearer to one side in the X direction beyond the reference position that offsets in the X direction by a half pitch P½ of the predetermined pitch P1 relative to the different tube arrays 22.

Figure 7:
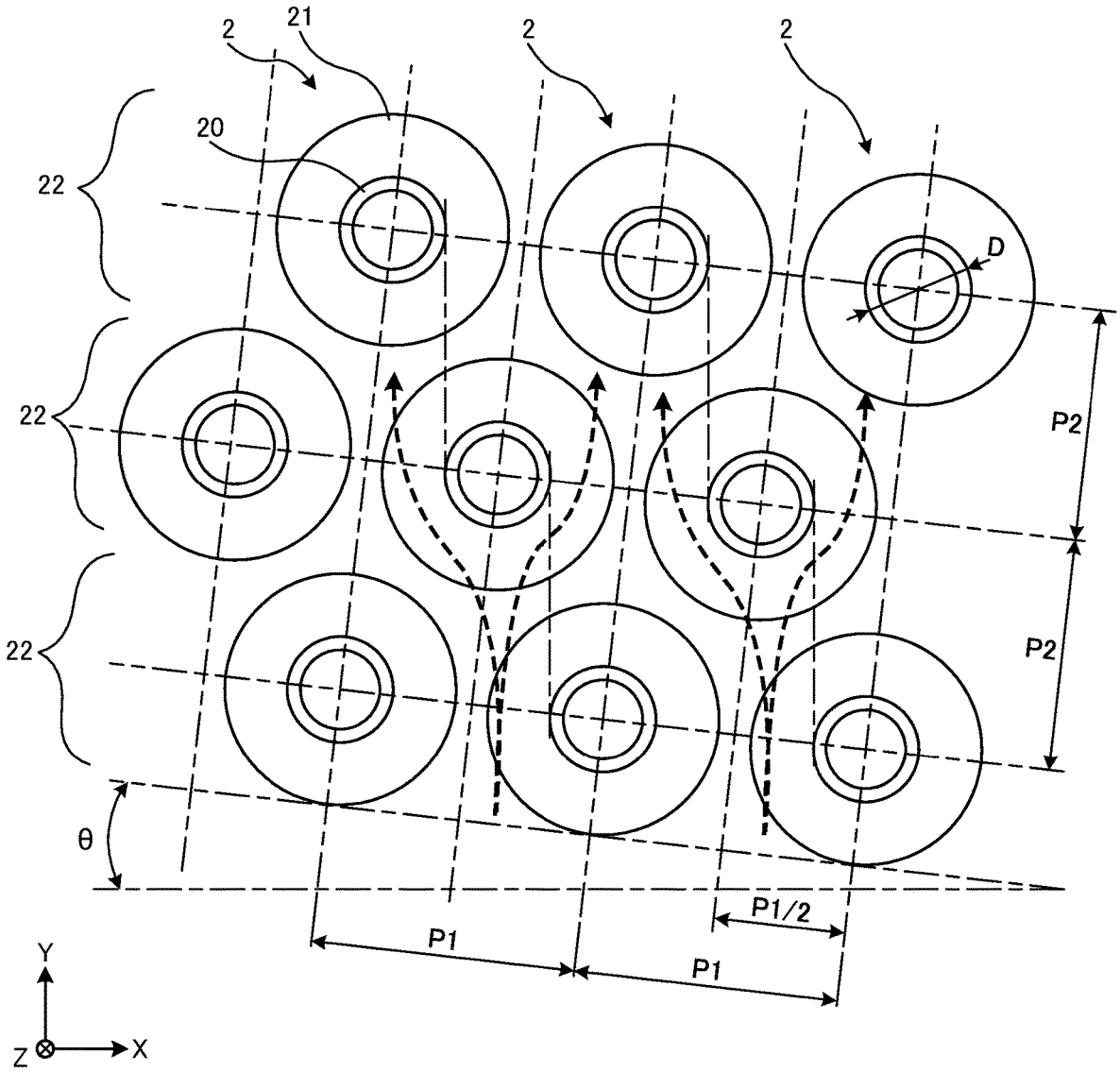
FIG. 7 is a sectional schematic view of a finned tube heat exchanger according to a second embodiment.

Next, a second embodiment will be described with reference to FIG. 7. FIG. 7 is a sectional schematic view of a finned tube heat exchanger according to the second embodiment. The aforementioned first embodiment is configured such that the predetermined tube array 22 is made to offset from the staggered arrangement. The second embodiment illustrated in FIG. 7 is different from the first embodiment in that the entire heat exchanger 1 is inclined at a predetermined angle while the plurality of tube arrays 22 are in staggered arrangement. Therefore, the same reference signs will be applied to configurations that have already been described, and description will be appropriately omitted.

As illustrated in FIG. 7, the predetermined tube array 22 is disposed at a reference position that offsets in the first direction by the half pitch P½ of the predetermined pitch P1 relative to the different tube arrays 22. Also, the first direction is inclined at a predetermined angle θ relative to the direction (X direction) that perpendicularly intersects the flow direction (Y direction) of the heat exchanging air. The heat transfer tubes 20 in the predetermined tube array 22 are disposed nearer to the side of the heat transfer tubes 20 in the different tube arrays 22 that are adjacent when seen from the flow direction of the heat exchanging air in this case as well.

Also, the inclination angle θ of the heat exchanger 1 is preferably 9 degrees, for example. When this angle is employed, the heat transfer tubes 20 in the predetermined tube array 22 are disposed in contact with the outer surfaces of the heat transfer tubes 20 in the different tube arrays 22 that are adjacent when seen from the flow direction of the heat exchanging air as illustrated in FIG. 7. In this manner, it is possible to reduce a pressure loss ratio while maintaining the heat exchanging performance ratio to be equivalent to that in the related art in the second embodiment as well. Note that the inclination angle θ of the heat exchanger 1 is not limited thereto and can be appropriately changed. Also, it is possible to increase the number of disposed heat transfer tubes 20 (finned tubes 2) and to improve heat exchanging performance by obliquely inclining the entire heat exchanger 1. Moreover, since it is only necessary to incline the heat exchanger 1, it is possible to effectively use the existing configuration and to reduce the number of design processes.

Also, the shape of the heat transfer tubes 20, the number of disposed heat transfer tubes 20, the layout, and the like are not limited thereto, and changes can be appropriately made in the aforementioned embodiments. Similarly, the number and the amount of offset of the tube arrays 22 can be appropriately changed.

Although the present embodiments and the modification example have been described, the aforementioned embodiments and the modification example may be entirely or partially combined.

Also, the present embodiments are not limited to the aforementioned embodiments and modification example, and various changes, replacements, and amendments may be added without departing from the gist of the technical idea. Moreover, the technical idea may be performed using other methods as long as it is possible to realize the technical idea by the methods based on development of the technique or other techniques derived therefrom. Therefore, the claims cover the entire embodiments that can be included within the scope of the technical idea.

Features of the aforementioned embodiments will be summarized below.

A finned tube heat exchanger according to the aforementioned embodiments includes: tube arrays in which a plurality of heat transfer tubes are disposed side by side at a predetermined pitch in a first direction that intersects a flow direction of heat exchanging air, the plurality of tube arrays being disposed at a predetermined interval in a second direction that intersects the first direction, a predetermined tube array is disposed in an offset manner in the first direction relative to different tube arrays that are adjacent in the second direction, and when seen from the flow direction of the heat exchanging air, the heat transfer tubes in the predetermined tube array are disposed nearer to a side of the heat transfer tubes in the different tube arrays that are adjacent.

In the finned tube heat exchanger according to the aforementioned embodiments, the predetermined tube array is disposed nearer to one side in the first direction beyond a reference position that offsets in the first direction by a half pitch of the predetermined pitch relative to the different tube arrays.

In the finned tube heat exchanger according to the aforementioned embodiments, the predetermined tube array is disposed at a reference position that offsets in the first direction by a half pitch of the predetermined pitch relative to the different tube arrays, and the first direction is inclined at a predetermined angle relative to a direction that perpendicularly intersects the flow direction of the heat exchanging air.

In the finned tube heat exchanger according to the aforementioned embodiments, the predetermined angle is 9 degrees.

In the finned tube heat exchanger according to the aforementioned embodiments, when seen from the flow direction of the heat exchanging air, the heat transfer tubes in the predetermined tube array are disposed in contact with outer surfaces of the heat transfer tubes in the different tube arrays that are adjacent.

In the finned tube heat exchanger according to the aforementioned embodiments, when seen from the flow direction of the heat exchanging air, the heat transfer tubes in the predetermined tube array are disposed such that at least a part thereof overlaps the heat transfer tubes in the different tube arrays that are adjacent.

In the finned tube heat exchanger according to the aforementioned embodiments, when a distance between centers of the heat transfer tubes in the predetermined tube array and the centers of the heat transfer tubes in the different tube arrays that are adjacent is defined as S, and an outer diameter of the heat transfer tubes is defined as D, a relationship of $0.95 \leq S/D \leq 1.38$ is satisfied.

INDUSTRIAL APPLICABILITY

As described above, the present invention has an effect that it is possible to reduce a pressure loss of heat exchanging air while maintaining heat exchanging performance, and the present invention is particularly useful as a finned tube heat exchanger used as a radiator for geothermal binary power generation.

The present application is based on Japanese Patent Application No. 2020-140874 filed on Aug. 24, 2020. The entire content thereof will be included herein.

What is claimed is:

1. A finned tube heat exchanger, comprising:

a plurality of tube arrays, each of which includes a plurality of heat transfer tubes, the plurality of heat transfer tubes included in each tube array each extending parallel to one another and being disposed at a predetermined pitch in a first direction that intersects a flow direction of heat exchanging air, wherein in a second direction that intersects the first direction, any closest two of the plurality of tube arrays has a predetermined distance therebetween, one closest two of the plurality of tube arrays in the second direction includes first and second tube arrays that respectively include a plurality of first heat transfer tubes and a plurality of second heat transfer tubes, the plurality of first heat transfer tubes in the first tube array are respectively disposed in an offset manner in the first direction relative to the plurality of second heat transfer tubes in the second tube array such that when seen from the flow direction of the heat exchanging air, each first heat transfer tube is disposed closer to one of an adjacent two second heat transfer tubes that is closest to said each first heat transfer tube, than to the other one of the adjacent two second heat transfer tubes, each first heat transfer tube is disposed at a reference position that is offset in the first direction by a half pitch of the predetermined pitch relative to a position of each second heat transfer tube, and the first direction is inclined at a predetermined angle relative to a direction perpendicular to the flow direction of the heat exchanging air.

2. The finned tube heat exchanger according to claim 1, wherein the predetermined angle is 9 degrees.

3. A finned tube heat exchanger, comprising:

a plurality of tube arrays, each of which includes a plurality of heat transfer tubes, the plurality of heat transfer tubes included in each tube array each extending parallel to one another and being disposed at a predetermined pitch in a first direction that intersects a flow direction of heat exchanging air, wherein in a second direction that intersects the first direction, any closest two of the plurality of tube arrays has a predetermined distance therebetween, one closest two of the plurality of tube arrays in the second direction includes first and second tube arrays that respectively include a plurality of first heat transfer tubes and a plurality of second heat transfer tubes, the plurality of first heat transfer tubes in the first tube array are respectively disposed in an offset manner in the first direction relative to the plurality of second heat transfer tubes in the second tube array such that when seen from the flow direction of the heat exchanging air, each first heat transfer tube is disposed closer to one of an adjacent two second heat transfer tubes that is closest to said each first heat transfer tube, than to the other one of the adjacent two second heat transfer tubes, and an outer surface of each first heat transfer tube is in contact with an outer surface of one of the second heat transfer tubes that is closest to said each first heat transfer tube.

4. A finned tube heat exchanger, comprising:

a plurality of tube arrays, each of which includes a plurality of heat transfer tubes, the plurality of heat transfer tubes included in each tube array each extending parallel to one another and being disposed at a predetermined pitch in a first direction that intersects a flow direction of heat exchanging air, wherein in a second direction that intersects the first direction, any closest two of the plurality of tube arrays has a predetermined distance therebetween, one closest two of the plurality of tube arrays in the second direction includes first and second tube arrays that respectively include a plurality of first heat transfer tubes and a plurality of second heat transfer tubes, the plurality of first heat transfer tubes in the first tube array are respectively disposed in an offset manner in the first direction relative to the plurality of second heat transfer tubes in the second tube array such that when seen from the flow direction of the heat exchanging air, each first heat transfer tube is disposed closer to one of an adjacent two second heat transfer tubes that is closest to said each first heat transfer tube, than to the other one of the adjacent two second heat transfer tubes, and when seen from the flow direction of the heat exchanging air, each first heat transfer tube is disposed such that at least a part of said each first heat transfer tube overlaps in the first direction one of the second heat transfer tubes that is closest to said each first heat transfer tube.

5. A finned tube heat exchanger, comprising:

a plurality of tube arrays, each of which includes a plurality of heat transfer tubes, the plurality of heat transfer tubes included in each tube array each extending parallel to one another and being disposed at a predetermined pitch in a first direction that intersects a flow direction of heat exchanging air, wherein in a second direction that intersects the first direction, any closest two of the plurality of tube arrays has a predetermined distance therebetween, one closest two of the plurality of tube arrays in the second direction includes first and second tube arrays that respectively include a plurality of first heat transfer tubes and a plurality of second heat transfer tubes, the plurality of first heat transfer tubes in the first tube array are respectively disposed in an offset manner in the first direction relative to the plurality of second heat transfer tubes in the second tube array such that when seen from the flow direction of the heat exchanging air, each first heat transfer tube is disposed closer to one of an adjacent two second heat transfer tubes that is closest to said each first heat transfer tube, than to the other one of the adjacent two second heat transfer tubes, and when a shortest distance between a center of each first heat transfer tube and a center of one of the second heat transfer tubes that is closest to said each first heat transfer tube, is defined as S, and an outer diameter of each of the first and second heat transfer tubes is defined as D, a relationship of $0.95 \leq S/D \leq 1.38$ is satisfied.

* * * * *